US011458518B2

(12) United States Patent
Hofbauer et al.

(10) Patent No.: US 11,458,518 B2
(45) Date of Patent: Oct. 4, 2022

(54) ROLLING MILL WITH ROLLING DEPENDENT ON MATERIAL PROPERTIES

(71) Applicant: Primetals Technologies Germany GmbH, Erlangen (DE)

(72) Inventors: Josef Hofbauer, Erlangen (DE); Thomas Matschullat, Eckental (DE)

(73) Assignee: PRIMETALS TECHNOLOGIES GERMANY GMBH

( * ) Notice: Subject to any disclaimer, the term of this patent is extended or adjusted under 35 U.S.C. 154(b) by 0 days.

(21) Appl. No.: 17/149,799

(22) Filed: Jan. 15, 2021

(65) Prior Publication Data

US 2021/0229149 A1 Jul. 29, 2021

(30) Foreign Application Priority Data

Jan. 28, 2020 (EP) ..... 20154128

(51) Int. Cl.
*B21B 37/20* (2006.01)
*B21B 37/46* (2006.01)

(52) U.S. Cl.
CPC ..... *B21B 37/20* (2013.01); *B21B 37/46* (2013.01); *B21B 2261/20* (2013.01); *B21B 2265/12* (2013.01); *B21B 2275/05* (2013.01)

(58) Field of Classification Search
CPC . B21B 37/46; B21B 2275/02; B21B 2275/04; B21B 2275/06; B21B 37/18;
(Continued)

(56) References Cited

U.S. PATENT DOCUMENTS 3,394,587 A * 7/1968 Freeman ..... B65H 23/044 73/862.41
3,756,050 A * 9/1973 Kubo ..... G01B 7/287 72/9.1
(Continued)

FOREIGN PATENT DOCUMENTS

CN 108 906 887 A 11/2018
EP 2 548 663 A2 1/2013
(Continued)

OTHER PUBLICATIONS

Search Beport dated Jul. 13, 2020 in corresponding European Patent Application No. 20154128.1.
(Continued)

*Primary Examiner* — Edward T Tolan
(74) *Attorney, Agent, or Firm* — Ostrolenk Faber LLP

(57) ABSTRACT

A rolling mill has a rolling stand (1) in which a flat rolled product (2) composed of metal is rolled. A sensor device (6), which detects at least one measured variable (M) characteristic of a material property of the flat rolled product (2), is arranged upstream and/or downstream of the rolling stand (1). The material property can be, in particular, an electromagnetic property or a mechanical property of the rolled product (2). The sensor device (6) transfers the detected measured variable (M) to a control device (9) for the rolling mill. Taking into account the measured variable (M), the control device (9) determines a control value (A) for the rolling stand (1). The control of the rolling stand (1) influences the material property of the flat rolled product (2). The control value (A) is a ratio of the peripheral speeds (vO, vU) at which the upper and the lower working rolls (3, 4) of the rolling stand (1) rotate.

15 Claims, 9 Drawing Sheets

(58) Field of Classification Search
CPC ..... B21B 37/70; B21B 37/72; B21B 38/006; B21B 38/04; B21B 2265/04; B21B 37/20; B21B 2261/20; B21B 2265/12
See application file for complete search history.

(56) References Cited

U.S. PATENT DOCUMENTS

| | | | | |
|---|---|---|---|---|
| 3,850,031 | A * | 11/1974 | Schwenzfeier | G01N 29/045 73/862.41 |
| 4,145,902 | A * | 3/1979 | Imai | B21B 37/46 700/151 |
| 4,566,299 | A * | 1/1986 | Koyama | B21B 37/46 72/10.2 |
| 6,286,348 | B1 * | 9/2001 | Sekiguchi | B21B 37/66 72/10.3 |
| 6,546,310 | B1 * | 4/2003 | Doll | G05B 13/0265 700/150 |
| 7,812,558 | B2 * | 10/2010 | Mori | B21B 37/46 318/432 |
| 8,424,354 | B2 * | 4/2013 | Pavlicevic | B21B 35/04 72/241.2 |
| 9,421,592 | B2 | 8/2016 | Jeong et al. | 72/199 |
| 2013/0031944 | A1 | 2/2013 | Muralidharan et al. | 72/200 |
| 2017/0259313 | A1 * | 9/2017 | Fairlie | B21B 37/16 |
| 2019/0071750 | A1 | 3/2019 | Biglari et al. | |
| 2019/0255584 | A1 * | 8/2019 | Lengauer | B23P 17/00 |
| 2019/0292624 | A1 * | 9/2019 | Biglari | G01N 33/204 |

FOREIGN PATENT DOCUMENTS

| | | | |
|---|---|---|---|
| SU | 961809 | A1 | 9/1982 |
| SU | 969343 | A1 | 10/1982 |
| WO | WO 2017/157692 | A1 | 9/2017 |

OTHER PUBLICATIONS

"Zerstörungsfreie On-line Werkstoffprüfung für kaltgewalzte und oberflächenveredelte Stahlbänder," Stahl Und Eisen, vol. 120, No. 3, Mar. 15, 2000, p. 54, XP000945578, ISSN: 0340-4803 (see European Search Report for relevance).

G. Hirt et al., "Umformtechnik für die Elektromobilität" (Forming technology for electro-mobility, URL address: https://publications.rwth-aachen.de/record/762556/files/762556.pdf, download date: Jan. 21, 2020 (with English language abstract).

Russian Federation Notice of Allowance, dated Dec. 21, 2021, issued in corresponding Russian Patent Application No. 2020139282/05(072958). Total 13 pages.

* cited by examiner

A=0,5 2,0 (0,9...1,1)

vO*=A·vU*

A=0,5 2,0 (0,9...1,1)

ROLLING MILL WITH ROLLING DEPENDENT ON MATERIAL PROPERTIES

CROSS-REFERENCE TO RELATED APPLICATIONS

The present application claims priority of European Patent Application No. 20154128.1 filed Jan. 28, 2020, the contents of which are incorporated by reference herein.

TECHNICAL FIELD

The present invention starts from a rolling mill having a first rolling stand for rolling a flat rolled product composed of metal. A sensor device is arranged upstream and/or downstream of the first upstream rolling stand.

The sensor device is connected to a control device for the rolling mill in order to transfer the detected measured variable. The control device is configured and operable in such that it takes into account the transferred measured variable in a context of determining a control value for the first rolling stand.

The sensor device is configured and operable in such that at least one measured variable characteristic of a material property of the flat rolled product can be detected.

The control of the first rolling stand with the control value influences the material property of the flat rolled product.

The first rolling stand has an upper working roll and a lower working roll.

In the context of the present invention, the term "first rolling stand" is not intended to mean that the rolling mill necessarily has a plurality of rolling stands and that the first rolling stand is the forwardmost upstream rolling stand, through which the flat rolled product first runs. On the contrary, it is first intended to include the case where the rolling mill has only the first rolling stand. In this case, only the first rolling stand is present. Moreover, in the case where the rolling mill has a plurality of rolling stands, the term "first rolling stand" also serves merely to distinguish it from the other rolling stands of the rolling mill. On the other hand, no implied sequence is intended. Thus, even in this case, the first rolling stand can be arranged at any location in the succession of rolling stands of the rolling mill. Thus, for example, if the flat rolled product runs first through a rolling stand A, then through a rolling stand B, then through a rolling stand C and finally through a rolling stand D, the first rolling stand can be any of rolling stands A to D, while the other rolling stands are second rolling stands.

In the production of a flat rolled product, the objective is to set the geometrical properties of the flat rolled product, especially its width and thickness, with the maximum possible precision. The same objective also applies to the profile or contour. Flatness is also to be maintained. In addition to these and possibly also other geometrical properties, material properties of the flat rolled product are furthermore also to be set. Material properties are properties which the flat rolled product should have in subsequent use, e.g. a certain yield strength, a certain material hardness or a certain magnetizability. Material properties are therefore properties which the material has irrespective of its specific current state (e.g. temperature) and also irrespective of its geometrical properties. The reason for certain material properties, apart from the material as such, is the grain structure of the metal.

The material properties can be set, at least partially, during the rolling of the flat rolled product. Often, however, there is a difference between the actual value of a material property and a desired target value. In this case, it is necessary to heat treat the flat rolled product after hot rolling. This applies very particularly if a "Goss texture" is to be established in the rolled product. However, similar problems are encountered also with certain steels, especially with AHSS (=advanced high strength steel) and with martensitic and bainitic grades. For heat treatment, the rolled product can be cooled in a suitable manner in a cooling section after the hot rolling or it can be treated in an annealing step in the context of cold rolling, for example, in order to set material properties. As an alternative, this treatment can take place after cold rolling or between two cold rolling steps.

PRIOR ART

From the technical article "Umformtechnik für die Elektromobilitat" [Forming technology for electro-mobility] by Gerhard Hirt et al., accessed on 21.01.2020 at https://publications.rwth-aachen.de/record/762556/files/762556.pdf, it is known that "asymmetric" rolling may be advantageous for establishing a texture of the rolled product which is favorable for magnetization. In asymmetric rolling, the peripheral speeds of an upper and a lower working roll of a rolling stand differ from one another. During rolling, shear forces therefore act on the flat rolled product in the transport direction. Owing to the shear forces, reordering of the crystal orientation is brought about.

A rolling mill of the type stated at the outset is known from WO 2017/157 692 A1, for example. In this rolling mill, the pass reduction or the rolling force, for example, are adjusted by means of the control value.

SUMMARY OF THE INVENTION

It is the object of the present invention to provide ways of enabling selective adjustment of an electric, magnetic or mechanical material property of the flat rolled product in a simple and reliable manner as required.

According to the invention, in a rolling mill of the type stated at the outset, the control device is configured and operable such that the control value determined taking into account the measured variable is a ratio of an upper peripheral speed at which the upper working roll rotates to a lower peripheral speed at which the lower working roll rotates.

Thus, a measured variable is detected, by means of which the corresponding material property of the flat rolled product can be directly determined at the point in time of measurement. There is thus a direct functional relationship between the measured variable, on the one hand, and the material property, on the other hand. In contrast, it is not necessary to perform complicated model calculations by means of which a development with respect to time can be modeled, for example.

Here, the phrase "at the point in time of measurement" is not intended to imply that, owing to the change in the state of the flat rolled product, e.g. its temperature, the material property likewise inevitably changes continuously in the course of time. However, the material property can be set to a different value by a corresponding treatment of the rolled product, e.g. by rolling in the first rolling stand or rolling in some other rolling stand or by means of a thermal treatment at a later time.

It is possible for the rolling mill to have only the first rolling stand mentioned and consequently to have only a single rolling stand. In this case, the sensor device is arranged entirely on its own immediately upstream or immediately downstream of the rolling stand. However, it is likewise possible for the rolling mill also to have at least one second rolling stand in addition to the first rolling stand. A number of different embodiments are possible in this case.

Thus, for example, it is possible for the second rolling stands not to be arranged between the sensor device and the first rolling stand. This embodiment is implemented, for example, when the sensor device is arranged upstream of the forwardmost upstream rolling stand of a multi-stand rolling train. The control value is determined by the control device taking into account the measured variable which acts on the forwardmost rolling stand or, conversely, the sensor assembly is arranged downstream of the last rolling stand of a multi-stand rolling train and the control value determined by the control device takes into account the measured variable which acts on the last rolling stand. This embodiment is likewise implemented, for example, when the sensor assembly is arranged between two rolling stands of a multi-stand rolling train and the control value determined by the control device takes into account the measured variable acts on one of these two rolling stands, or the control device determines two such control values, each one of which acts on a respective one of these two rolling stands.

As an alternative, it is possible for at least one of the second rolling stands to be arranged between the sensor device and the first rolling stand. This embodiment is implemented, for example, when the sensor device is arranged upstream of the forwardmost rolling stand of a multi-stand rolling train and the control value is determined by the control device taking into account the measured variable which acts on a rolling stand other than the forwardmost rolling stand or, conversely, the sensor assembly is arranged downstream of the last rolling stand of a multi-stand rolling train, and the control value determined by the control device takes into account the measured variable acting on a rolling stand other than the last rolling stand.

Of course, combinations of these approaches are also possible. Thus, for example, the sensor device can be arranged upstream of the forwardmost rolling stand of the multi-stand rolling train and, furthermore, a plurality of control values, one of which acts on the forwardmost rolling stand and another of which acts on a different rolling stand, can be determined by the control device taking into account the measured variable. Conversely, it is likewise possible for the sensor assembly to be arranged downstream of the last rolling stand of the multi-stand rolling train and, furthermore, for a plurality of control values, one of which acts on the last rolling stand and another acts on a different rolling stand, to be determined by the control device taking into account the measured variable.

The control device is preferably designed such that it determines the ratio of the upper roll peripheral speed to the lower peripheral speed in such a way that it is between 0.5 and 2.0, in particular between 0.9 and 1.1. It is thereby possible to cover all cases that are relevant in practice.

To be able to implement peripheral speeds that are different from one another, it is possible for the upper working roll to be driven by an upper drive and for the lower working roll to be driven by a lower drive, which is different from the upper drive. In this case, the different peripheral speeds can be implemented simply by corresponding setting of the two drives to different speeds.

As an alternative, it is possible for the upper working roll and the lower working roll to be driven by a common drive. In this case, a transmission provides a ratio of a speed of an upper output shaft of the transmission, with a shaft connected for conjoint rotation to the upper working roll, and provides a speed of a lower output shaft of the transmission, which lower shaft is connected for conjoint rotation to the lower working roll. The ratio can be continuously adjusted. The transmission is arranged between the common drive on one side and the upper working roll and the lower working roll on the other side.

In addition to setting a ratio of the peripheral speeds to one another, the control device may be designed such that the control value determined takes into account the measured variable which is a temperature modification of the upper working roll and/or of the lower working roll of the first rolling stand and/or of the flat rolled product before rolling in the first rolling stand. For example, cooling can be brought about by spraying on water, or heating can be brought about by induction heating.

If the sensor device is arranged upstream of the first rolling stand, the control device is preferably designed such that it outputs the control value to the first rolling stand, wherein the control value determined takes into account the measured variable, takes into account tracking of the flat rolled product from the sensor device to the first rolling stand. In controlling the first rolling stand, the control device thus takes into account the transport time which lapses between the detection of the measured variable for a certain segment of the flat rolled product and the rolling of the same segment of the flat rolled product in the first rolling stand.

The control device preferably comprises a model, by means of which the control device determines the control value for the first rolling stand, taking into account the measured variable, taking into account the control value determined taking into account the measured variable, and furthermore determines an expected value for the material property of the flat rolled product after rolling in the first rolling stand. A further sensor device, which can detect at least one further measured variable characteristic of the material property of the flat rolled product after rolling in the first rolling stand. It is furthermore preferably arranged downstream of the first rolling stand. The further sensor device is connected to the control device to transfer the detected further measured variable. Finally, the control device is preferably designed in such that it uses the further measured variable for a point in time which the control device determines, taking into account tracking of the flat rolled product from the first rolling stand to the further sensor device, and also adapts the model on the basis of a comparison of the further measured variable and the expected value of the material property. This procedure enables the model to be gradually adapted, better and better, to the actual behavior of the flat rolled product.

The control device is preferably configured such that determining the control value takes into account the temperature of the flat rolled product before the rolling of the flat rolled product in the first rolling stand and/or the rolling force during the rolling of the flat rolled product in the first rolling stand and/or the pass reduction during the rolling of the flat rolled product in the first rolling stand, in addition to the transferred measured variable. It is thereby possible to set the desired material property with a higher accuracy. The required dependency relationships can be stored in the control device in the form of characteristic maps, for example.

In a preferred embodiment, the sensor device comprises an excitation element and a first sensor element. A base signal is excited in the flat rolled product by means of the excitation element. Based on the excited base signal, a first sensor signal is detected by means of the first sensor element. It is possible for the sensor device to determine the transferred measured variable taking into account the first sensor signal. As an alternative, it is possible for the transferred measured variable to comprise the first sensor signal.

In individual cases, it may be possible to detect exclusively the first sensor signal. In general, however, the sensor device additionally comprises a number of second sensor elements. In this case, when viewed in the transport direction from the first sensor element, the respective second sensor element is arranged upstream or downstream of the first sensor element and/or laterally offset. A respective second sensor signal based on the excited base signal and of the same kind as the first sensor signal is detected by the respective second sensor element. It is possible for the sensor device to determine the transferred measured variable while also taking into account the respective second sensor signal. For example, the difference or the quotient of the corresponding sensor signals can be formed. As an alternative, it is possible for the transferred measured variable also to comprise the respective second sensor signal. In this case, similar evaluations can be carried out by the control device.

The base signal can be an eddy current, for example. Alternatively, the base signal can be a sound signal, in particular an ultrasound signal.

A connecting line from the excitation element to the first sensor element preferably runs parallel to the transport direction. This results in particularly reliable evaluation.

As already mentioned, the material property can be an electromagnetic property or a mechanical property of the rolled product.

In individual cases, hot rolling can be performed. In general, however, cold rolling is performed. Thus, the rolling mill is generally a cold rolling mill.

BRIEF DESCRIPTION OF THE DRAWINGS

The above-described properties, features and advantages of this invention and the manner in which these are achieved will become more clearly and distinctly comprehensible in conjunction with the following description of the illustrative embodiments, which are explained in greater detail in combination with the drawings. Here, in schematic illustrations.

DESCRIPTION OF THE EMBODIMENTS

Figure 1:
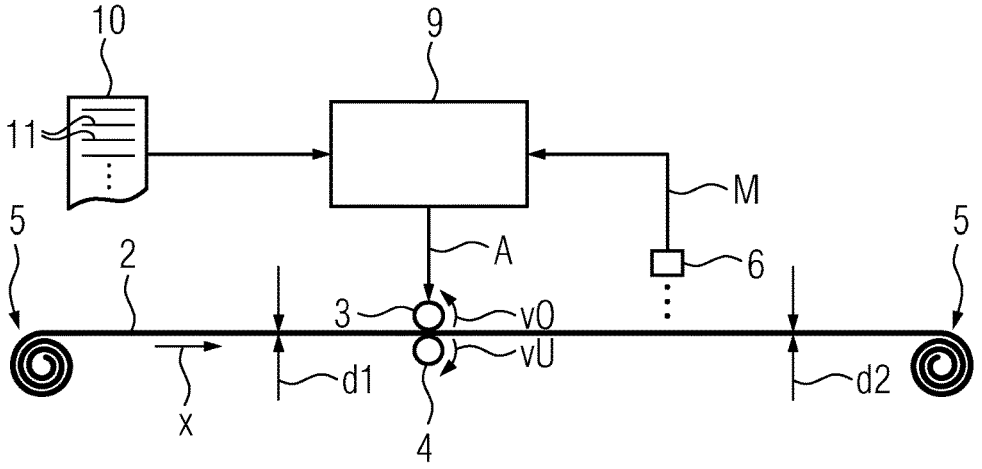
FIG. 1 shows a rolling mill having a first rolling stand.

According to FIG. 1, a rolling mill, has at least one first rolling stand 1, like any rolling mill. The first rolling stand 1 is used to roll a flat rolled product 2 composed of metal, in particular a strip. In particular, the metal of which the flat rolled product 2 is composed can be steel or aluminum. In the case of steel, the flat rolled product can be, in particular, electrical sheet steel with a relatively high proportion of silicon (usually between 2% and 4%).

Rolling can be hot rolling. In this case, the rolling mill is a hot rolling mill. Generally, however, cold rolling is involved. In this case, the rolling mill is a cold rolling mill.

Of the first rolling stand 1, FIG. 1 and also the other FIGURES illustrate only the upper working roll 3 and the lower working roll 4. In general, however, the first rolling stand 1 additionally has further rolls, e.g. supporting rolls in addition to the working rolls 3, 4 in the case of a four-high stand and, in addition to the working rolls 3, 4 and the supporting rolls, intermediate rolls arranged between the working rolls 3, 4 and the supporting rolls in the case of a six-high stand. Other configurations are also possible, e.g. a "20-roll" rolling stand. Irrespective of the specific embodiment, the upper working roll 3 rotates at an upper peripheral speed vO, while the lower working roll 4 rotates at a lower peripheral speed vU. Both the upper and the lower peripheral speeds vO, vU are greater the 0.

According to the illustration in FIG. 1, the rolling mill is designed as a reversing rolling mill. It therefore has respective coilers 5 for rolling the flat rolled product 2 upstream or downstream of the first rolling stand 1. In relation to the first rolling stand 1, the terms "upstream" and "downstream" should always be considered in connection with the transport direction x in which the flat rolled product 2 is rolled in the first rolling stand 1. In a reversing rolling mill, the terms "upstream" and "downstream" are therefore defined only during a respective rolling pass and are reversed in the respective next rolling pass.

A sensor device 6 is arranged downstream of the first rolling stand 1. By means of the sensor device 6, it is possible to detect a measured variable M. The detected measured variable M is characteristic of a material property of the flat rolled product 2. Examples of such properties are electric conductivity, relative permeability and magnetic saturation or, more generally, an electromagnetic property of the rolled product 2. Further examples of material properties are the proof stress, the yield strength, the elongation at break or, more generally, a mechanical property of the rolled product 2. The variables mentioned may be either nondirectional (i.e. isotropic) or directional (i.e. anisotropic). They are all based on the grain structure and, where applicable, the alignment of the grains of the metal of which the rolled product 2 is composed.

One possible embodiment of the sensor device 6 is explained below in conjunction with FIGS. 2 to 4. However, the present invention is not restricted to this embodiment of the sensor device 6.

Figure 2:
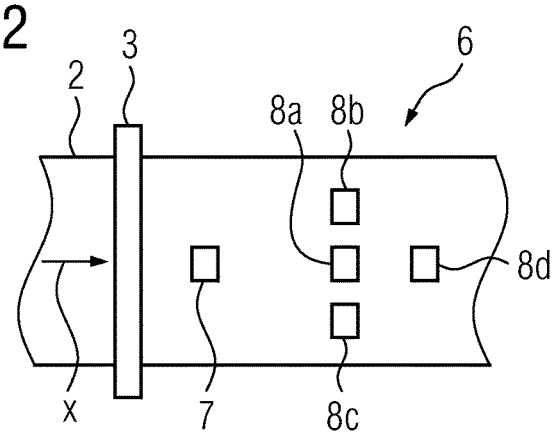
FIG. 2 shows a plan view of part of the rolling mill in FIG. 1.
Figure 3:
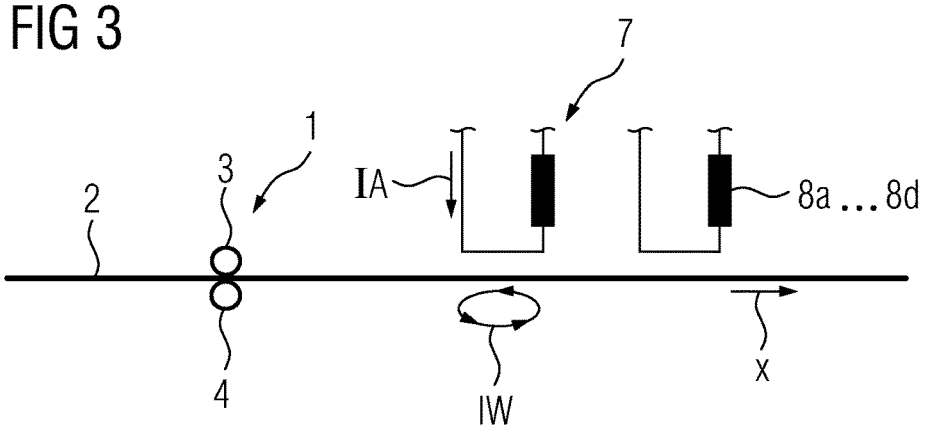
FIGS. 3 and 4 show side views of FIG. 3 at two points in time.
Figure 4:
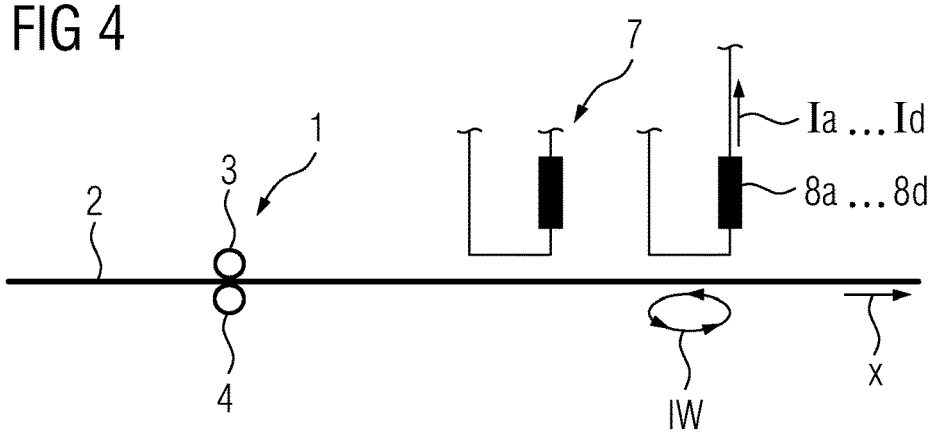

According to FIGS. 2 to 4, the sensor device 6 comprises an excitation element 7. A base signal can be excited in the flat rolled product 2 by means of the excitation element 7. According to the illustration in FIGS. 3 and 4, for example, the excitation element 7 can be configured as a coil which is supplied intermittently with an excitation current IA and thereby generates an eddy current IW as a base signal in the rolled product 2. FIG. 3 shows the sensor device 4 at a point in time at which the excitation element 7 is supplied with the excitation current IA.

The sensor device 6 furthermore comprises a first sensor element 8*a*. A first sensor signal Ia is detected by means of the first sensor element 8*a*. The detection of the first sensor signal Ia takes place after the excitation of the base signal, i.e. at a different, later point in time. At this later point in time, no base signal is generally being excited. However, a previously excited base signal has not yet fully died away.

The first sensor signal Ia is based on the excited base signal. According to the illustration in FIGS. 3 and 4, for example, the first sensor element 8*a* can be designed as a coil, and therefore, owing to the eddy current IW, a current is induced in the first sensor element 8*a*, which forms the first sensor signal Ia.

In FIGS. 2 to 4, the first sensor element 8*a* is illustrated as a different element from the excitation element 7. This embodiment is the usual case. In this case, the first sensor element 8*a* is arranged downstream of the excitation element 7 when viewed in the transport direction x of the rolled product 2. In this case, a connecting line from the excitation element 7 to the first sensor element 8*a* preferably runs parallel to the transport direction x. In individual cases, however, the first sensor element 8*a* can also be identical with the excitation element 7. This embodiment may be possible, in particular, when a period of time between the excitation of the base signal and the detection of the excited base signal is sufficiently short.

According to FIG. 1, the sensor device 6 is connected to a control device 9 for the rolling mill. By virtue of the connection of the sensor device 6 to the control device 9, it is possible, in particular, for the detected measured variable M to be transferred to the control device 9. It is possible for the transferred measured variable M to comprise the first sensor signal Ia. If the transferred measured variable M does not contain any further components, the transferred measured variable M may also be identical with the first sensor signal Ia. As an alternative, it is possible, in order to determine the measured variable M, for the sensor device 6 first of all to evaluate the first sensor signal Ia (and possibly further signals) and for the result of this evaluation to be the measured variable M. For example, the sensor device 6 can set the first sensor signal Ia in relation to the excitation signal IA and thereby determine the measured variable M.

Often, the sensor device 6 comprises a number of second sensor elements 8*b* to 8*d* in addition to the first sensor element 8*a*. The second sensor elements 8*b* to 8*d* are different elements from the first sensor element 8*a* (and in general also from the excitation element 7). As viewed from the excitation element 7, the second sensor elements 8*b* to 8*d* are generally arranged downstream of the excitation element 7, even if it is possible to depart from this in individual cases. By means of the second sensor elements 8*b* to 8*d*, it is possible to detect second sensor signals Ib to Id. The second sensor signals Ib to Id are likewise based on the excited base signal IW and are of the same kind as the first sensor signal Ia. The second sensor signals Ib to Id are generally detected simultaneously with the first sensor signal Ia.

If the second sensor elements 8*b* to 8*d* are additionally also present, the sensor device 6 can transfer all the sensor signals Ia to Id together as a measured variable M, for example, i.e. can transfer both the first sensor signal Ia and the second sensor signals Ib to Id. In this case, a corresponding evaluation of the sensor signals Ia to Id is performed by the control device 9. As an alternative, an evaluation of the sensor signals Ia to Id can already be performed (fully or partially) by the sensor device 6, and the result of this evaluation can be transferred as the measured variable M.

In respect of the arrangement of the second sensor elements 8*b* to 8*d* relative to the first sensor element 8*a*, various arrangements and embodiments are possible.

For example, the sensor device 6 can have a second sensor element 8*b*, 8*c* which is arranged laterally offset from the first sensor element 8*a* when viewed in the transport direction x. In this case, the sensor device 6 can set the first sensor signal Ic in relation to the second sensor signal Ib and thereby determine the measured variable M. In this case, it is possible, in particular, for the measured variable M to be determined from the difference or the quotient of the sensor signals Ia, Ib, Ic. If, as illustrated in FIG. 2, there is a respective second sensor element 8*b*, 8*c* on each of the two sides of the first sensor element 8*a*, the sensor device 6 can set the first sensor signal Ia in relation to the mean value of these two second sensor signals Ib, Ic.

As an alternative or in addition, it is possible for the sensor device 6 to have a second sensor element 8*d* which is arranged upstream or downstream of the first sensor element 8*a* when viewed in the transport direction x from the first sensor element 8*a*. In this case, an arrangement downstream of the first sensor element 8*a* is the usual case. Even when the second sensor element 8*d* is arranged upstream or downstream of the first sensor element 8*a*, the sensor device 6 can set the first sensor signal Ia in relation to the second sensor signal 8*d* and thereby determine the measured variable M. In this case too, it is possible, in particular, for the measured variable M to be determined from the difference or the quotient of the sensor signals Ia, Id.

Figure 5:
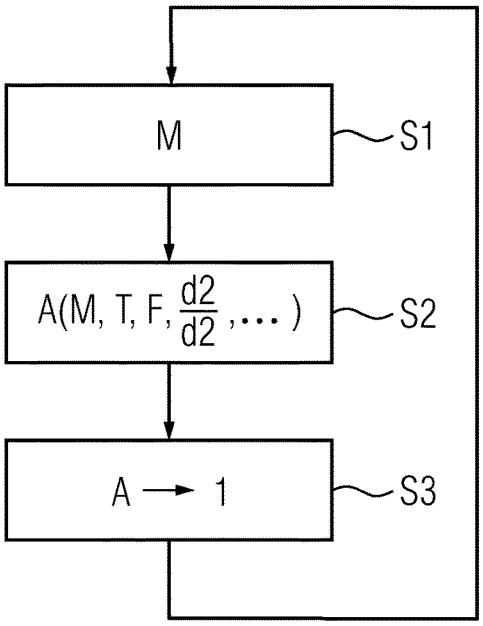
FIG. 5 shows a flow diagram.

According to FIG. 5, the control device 9 receives the measured variable M transferred to it in a step S1. In a step S2, the control device 9 determines a control value A for the first rolling stand 1. According to the illustration in FIG. 5, the control device 9 takes into account at least the transferred measured variable M in determining the control value A. Often, the control device 9 additionally also takes into account further variable data in determining the control value A, e.g. the temperature T of the flat rolled product 2 before rolling in the first rolling stand 1 and/or the rolling force F during the rolling of the flat rolled product 2 in the first rolling stand 1 and/or the pass reduction during the rolling of the flat rolled product 2 in the first rolling stand 1. The temperature T and the rolling force F can be detected by means of corresponding sensors, which are a matter of common knowledge to those skilled in the art. The pass reduction, i.e. the ratio of the thickness d2 of the flat rolled product 2 on the outlet side to the thickness d1 of the flat rolled product 2 on the inlet side (see FIG. 1) may be known to the control device 9, e.g. on the basis of a pass schedule. Furthermore, the control device 9 can take into account the speed of the flat rolled product 2 in the region of the sensor device 6, in particular in the context of evaluating the measured variable M. If required, the positions of the excitation element 7 and/or the sensor elements 8*a* to 8*d* can also be taken into account as well. In a step S3, the control device 9 controls the first rolling stand 1 in accordance with the control value A determined.

The control device 9 carries out steps S1 to S3 repeatedly in an iterative manner. A time constant with which the repetition takes place is generally in the range between 0.1 s and 1.0 s, in particular between 0.2 s and 0.5 s.

The control device 9 is designed in such a way that it carries out the procedure in FIG. 5. In accordance with the illustration in FIG. 1, the control device 9 is furthermore generally designed as a software-programmable control device. In this case, the control device 9 is programmed by means of a non-transitory control program 10. The control program 10 comprises program code 11 that can be executed by the control device 9. In operation, the control device 9 executes the program code 11. The execution of the program code 11 by the control device 9 has the effect that the control device 9 is of corresponding design.

In embodiments in which the base signal is an eddy current IW and thus an electric variable have been explained above in conjunction with FIGS. 1 to 5. These embodiments are expedient particularly if the measured variable M is supposed to be characteristic of an electric or magnetic material property.

However, these embodiments can also allow inferences about mechanical material properties.

Figure 6:
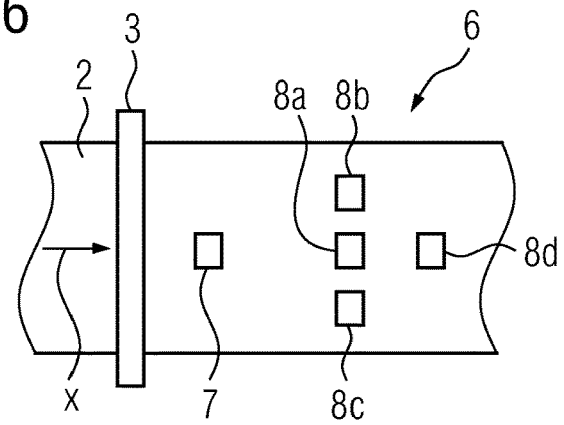
FIG. 6 shows a plan view of part of the rolling mill in FIG. 1.
Figure 7:
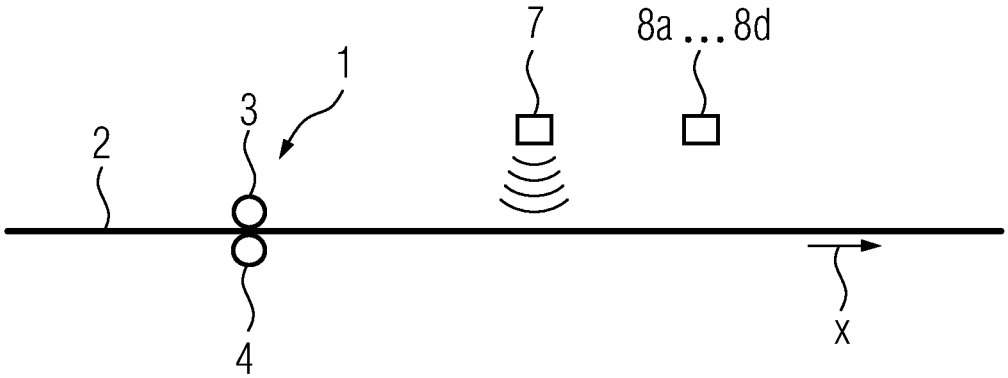
FIGS. 7 and 8 show side views of FIG. 6 at two points in time.
Figure 8:
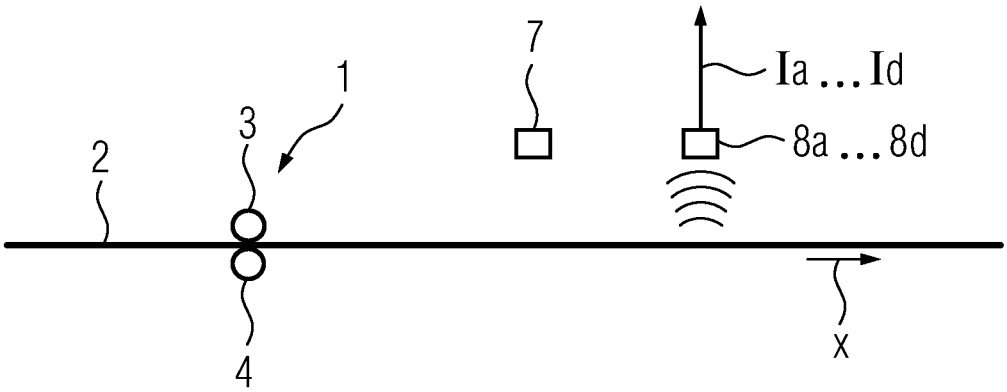

Another embodiment is explained below in conjunction with FIGS. 6 to 8. Here, FIGS. 6 to 8 show embodiments that are entirely analogous to FIGS. 2 to 4. The difference is that the excitation element 7 outputs a sound signal, in particular an ultrasound signal, in FIGS. 6 to 8. In a manner corresponding to this, the sensor elements 8*a* to 8*d* are also designed to detect a corresponding sound signal. In other respects, the embodiments in FIGS. 2 to 4 can be used in an analogous manner.

Figure 9:
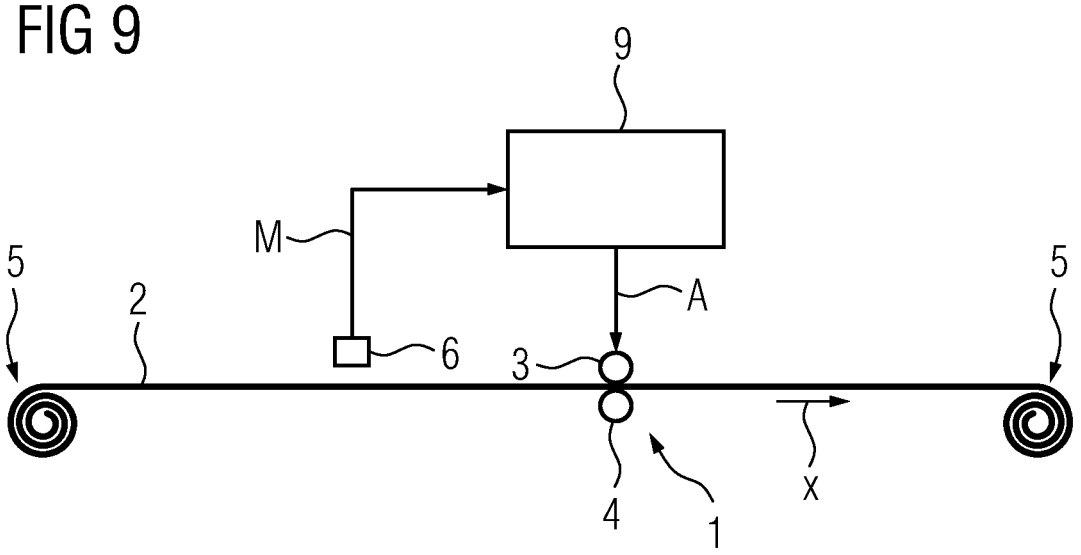
FIGS. 9 and 10 each show a further rolling mill having a first rolling stand.

FIG. 9 shows a modification of the rolling mill of FIG. 1. The difference is that, in the embodiment of the rolling mill according to FIG. 9, the sensor device 6 is no longer arranged downstream of the first rolling stand 1 but upstream of the first rolling stand 1. In other respects, the embodiments in FIG. 1 and also the embodiments in FIGS. 2 to 8 which build on those embodiments, e.g. the embodiments of the control device 9 as a software-programmable control device, can continue to be used. In the context of the embodiment according to FIG. 9, it is possible, in particular, for the control device 9 to output the control value A to the first rolling stand 1, which the control device 9 determines taking into account the measured variable M, taking into account tracking of the flat rolled product 2 from the sensor device 6 to the first rolling stand 1. The details in this regard are explained in conjunction with a further embodiment, which is explained below in conjunction with FIG. 10.

Figure 10:
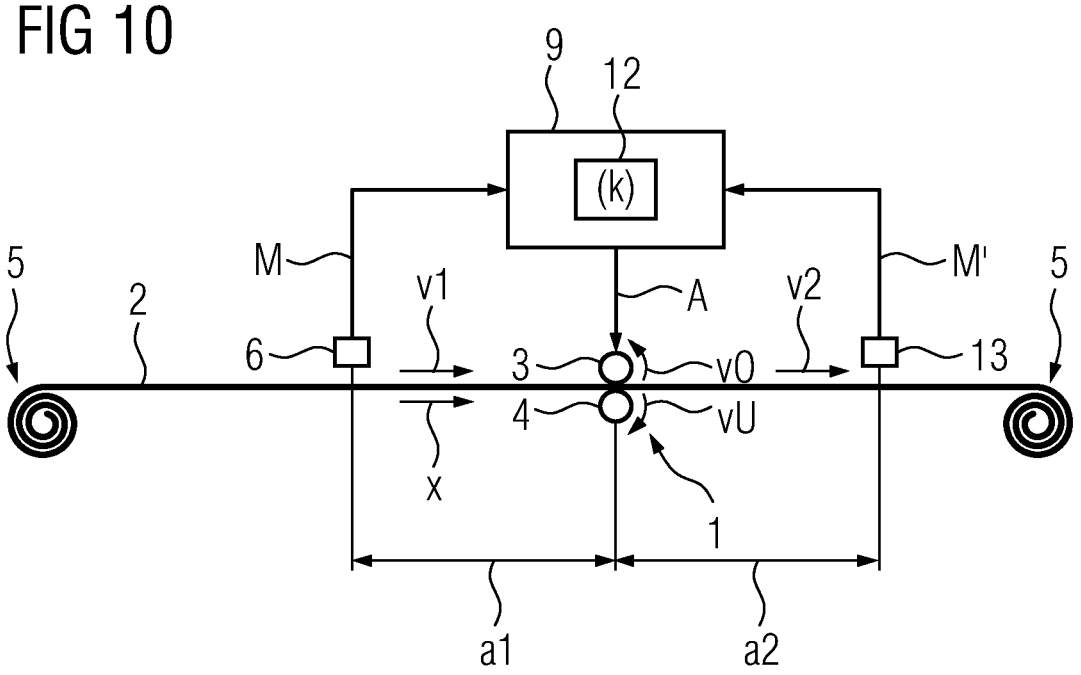

FIG. 10 takes FIG. 9 as its starting point. Just as in FIG. 9, therefore, the sensor device 6 in the embodiment according to FIG. 10 is arranged upstream of the first rolling stand 1. The control device 9 comprises, e.g. on the basis of the execution of the program code 11, a model 12. A further sensor device 13 is furthermore arranged downstream of the first rolling stand 1. By means of the further sensor device 13, it is possible to detect at least one further measured variable M'. The further measured variable M' detected is characteristic of the material property of the flat rolled product 2 after it has been rolled in the first rolling stand 1. The further measured variable M' is therefore characteristic of the same material property as the measured variable M and is thus similar in terms of approach to the measured variable M. The difference is that the measured variable M is characteristic of the material property of the flat rolled product 2 before rolling in the first rolling stand 1, while the measured variable M' is characteristic of the material property of the flat rolled product 2 after rolling in the first rolling stand 1.

The further sensor device 13 is likewise connected to the control device 9 for the rolling mill. By virtue of the connection of the further sensor device 13 to the control device 9, it is possible, in particular, for the detected further measured variable M' to be transferred to the control device 9.

The mode of operation of the rolling mill in FIG. 10 is explained below in conjunction with FIG. 11. Insofar as it relates to the taking into account of the tracking of the flat rolled product 2 from the sensor device 6 to the first rolling stand 1, FIG. 11 also shows the operation of the rolling mill of FIG. 9.

Figure 11:
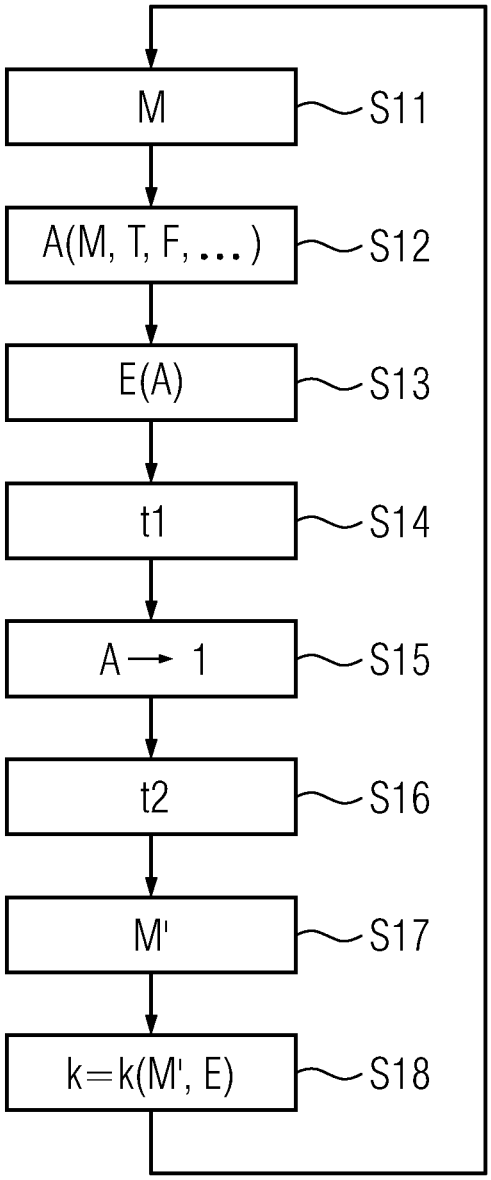
FIG. 11 shows a flow diagram.

According to FIG. 11, the control device 9 receives the measured variable M transferred to it in a step S11. Step S11 corresponds 1:1 to step S1 in FIG. 2. In a step S12, the control device 9 determines the control value A for the first rolling stand 1. Step S12 corresponds essentially to step S2 in FIG. 2. The difference is that, in step S12, the control device 9 determines the control value A by means of the model 12. The determination of the control value A incorporates inter alia a model parameter k.

In a step S13, taking into account this control value A, i.e. the control value A determined in step S12, the control device 9 determines an expected value E for the material property of the flat rolled product 2 after rolling in the first rolling stand 1. This determination too is carried out by means of the model 12.

In a step S14, the control device 9 waits for a first waiting time t1. The first waiting time t1 corresponds to the time which a certain segment of the flat rolled product 2 requires to reach the first rolling stand 1, starting from the sensor device 6. Thus, essentially, the control device 9 implements tracking of the flat rolled product 2 from the sensor device 6 to the first rolling stand 1. In the simplest case, the first waiting time t1, see FIG. 10, corresponds to the distance a1 from the sensor device 6 to the first rolling stand 1, divided by the transport speed v1 of the flat rolled product 2 upstream of the first rolling stand 1. If further rolling stands are arranged between the sensor device 6 and the first rolling stand 1, it may be necessary to determine the first waiting time t1 by adding a plurality of times, wherein each time is characteristic of a certain segment and is obtained from the transport speed of the flat rolled product 2 in the respective segment and the length of the respective segment.

In a step S15 and hence after the expiry of the first waiting time t1, the control device 9 controls the first rolling stand 1 in accordance with the control value A determined. Step S15 corresponds substantially to step S3 in FIG. 2. As a result, the control device 9 thus outputs the control value A to the first rolling stand 1 taking into account the tracking of the flat rolled product 2 from the sensor device.

In a step S16, the control device 9 then waits for a second waiting time t2. The second waiting time t2 corresponds to the time which a certain segment of the flat rolled product 2 requires to reach the further sensor device 13, starting from the first rolling stand 1. Thus, essentially, the control device 9 implements tracking of the flat rolled product 2 from the first rolling stand 1 to the further sensor device 13. In the simplest case t1, see once again FIG. 10, the second waiting time t2 corresponds to the distance a2 from the first rolling stand 1 to the further sensor device 13, divided by the transport speed v2 of the flat rolled product 2 downstream of the first rolling stand 1. If further rolling stands are arranged between the first rolling stand 1 and the further sensor device 13, it may be necessary to determine the second waiting time t2 by adding a plurality of times, wherein each time is characteristic of a certain segment and is obtained from the transport speed of the flat rolled product 2 in the respective segment and the length of the respective segment.

In a step S17 and hence after the expiry of the second waiting time t2, the control device 9 receives from the further sensor device 13 the further measured variable M' that is detected by the further sensor device 13 at this point in time. In a step S18, the control device 9 corrects the model parameter k from a comparison of the further measured variable M' and the expected value E of the material property E and thereby adapts the model 12. As a result, as part of the adaptation of the model 12, the control device 9 uses the further measured variable M' for a point in time which the control device 9 has determined taking into account the tracking of the flat rolled product 2 from the first rolling stand 1 to the further sensor device 13.

The control device 9 carries out steps S11 to S18 repeatedly in an iterative manner, in a manner similar to that for steps S1 to S3. The above statements relating to steps S1 to S3 can be applied in analogous fashion.

In practice, steps S11 to S18 and the sequence thereof are furthermore implemented in a slightly different way. For example, steps S11 to S18 can be carried out in several instances. It is also possible for the sequence of steps S11 to S18 to be divided into two parts that are carried out in parallel. In this case, the first part comprises steps S11 to S15, and the second part comprises steps S16 to S18.

It is also possible to omit steps S14 and S16 as such. In this case, direct, unsynchronized performance of the remaining steps S11 to S13, S15, S17 and S18 can take place. In this case, the respective control value A determined in step S12 and the respective expected value E determined in step S13 can be temporarily buffered in a buffer memory (not illustrated), for example. The respective further measured variable M' detected in step S17 can also optionally be temporarily buffered in the buffer memory. In this case, a point in time of execution is allocated to the respective control value A upon storage. In analogous fashion, a point in time of utilization is allocated to the respective expected value E in this case. Furthermore, a point in time of detection can optionally also be allocated to the respective further measured variable M'. In this case, the stored control value A whose point in time of execution has just been reached is output for the respective execution of step S15. In analogous fashion, the stored expected value E whose point in time of utilization coincides with the current time is used for the respective execution of step S18. To the extent necessary, it is possible in this context for interpolation of stored control values A and of stored expected values E to be carried out. If the further measured variables M' and the points in time of detection thereof are also stored, this applies analogously also to the further measured variables M'.

Irrespective of the specific implementation, however, it is important that the adaptation of the model 12 in step S18 acts on all the later executions of steps S12 and S13.

The nature of the control value A is determined so that the control of the first rolling stand 1 with the control value A influences the material property of the flat rolled product 2. In particular, in accordance with the illustration in FIGS. 12 and 13, the control device 9 determines a ratio of the upper peripheral speed vO to the lower peripheral speed vU as the control value A. This results in asymmetric rolling, in which the two working rolls 3, 4 rotate at different peripheral speeds vO, vU from one another. In accordance with the illustration in FIGS. 12 and 13, the control value A can be included in the determination of the upper peripheral speed vO (or the target value vO* thereof) as a factor by which the lower peripheral speed vU (or the target value vU* thereof) must be multiplied, for example.

In general, the ratio of the upper peripheral speed vO to the lower peripheral speed vU is between 0.5 and 2.0, in particular between 0.9 and 1.1. It is furthermore irrelevant in general which of the two working rolls 3, 4 rotates more rapidly than the other working roll 4, 3.

Figure 12:
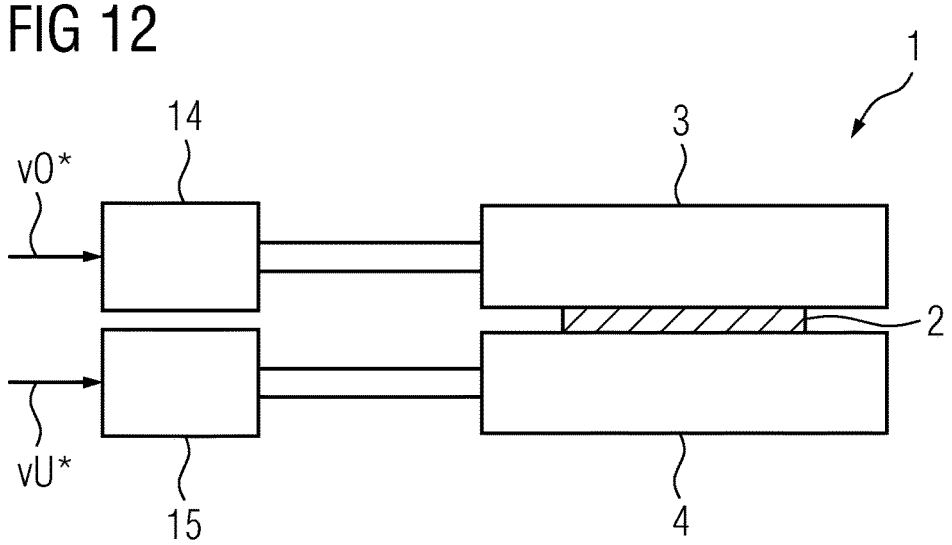
FIGS. 12 and 13 show drive structures for working rolls.

FIG. 12 furthermore shows an embodiment which is particularly simple to implement in terms of control engineering. To be specific, in the context of the embodiment in FIG. 12, the upper working roll 3 is driven by an upper drive 14, while the lower working roll 4 is driven by a lower drive 15. In the context of the embodiment according to FIG. 12, the lower drive 15 is a different drive from the upper drive 14. In this case, all that is required is to specify the corresponding target values vO*, vU* to the upper drive 14 and the lower drive 15.

Figure 13:
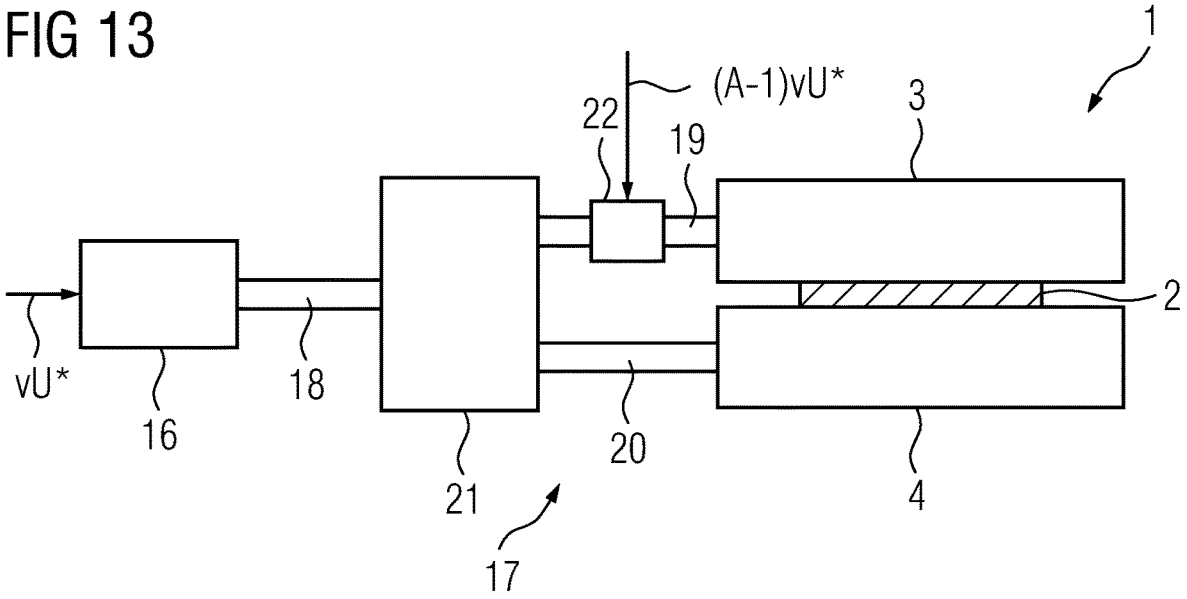

In contrast, the upper working roll 3 and the lower working roll 4 in the embodiment in FIG. 13 are driven by a common drive 16. In this case, a transmission 17 is arranged between the common drive 16 on one side and the upper working roll 3 and the lower working roll 4 on the other side. The transmission has an input shaft 18, on the one hand, and an upper output shaft 19 and a lower output shaft 20, on the other hand. The input shaft 18 is connected for conjoint rotation to the common drive 16. The upper output shaft 19 is connected for conjoint rotation to the upper working roll 3, while the lower output shaft 20 is connected for conjoint rotation to the lower working roll 4. The input shaft 18 acts both on the upper output shaft 19 and on the lower output shaft 20.

The transmission 17 is designed in such that a ratio of a speed of the upper output shaft 19 to a speed of the lower output shaft 20 can be continuously adjusted by means of the transmission 17. For example, the transmission 17 can have, on the one hand, a splitter block 21, in which the drive train is split between the upper and the lower working roll 3, 4. Between the splitter block 21 and the upper working roll 3 it is then possible to arrange an intermediate transmission 22, by means of which continuous variation of the output speed relative to the input speed of the intermediate transmission 22 is possible. Intermediate transmissions 22 of this kind are a matter of common knowledge to those skilled in the art. Examples are a planetary transmission and a differential transmission. As an alternative or in addition to arrangement between the splitter block 21 and the upper working roll 3, it is also possible for an intermediate transmission (not illustrated) to be arranged between the splitter block 21 and the lower working roll 4.

Figure 14:
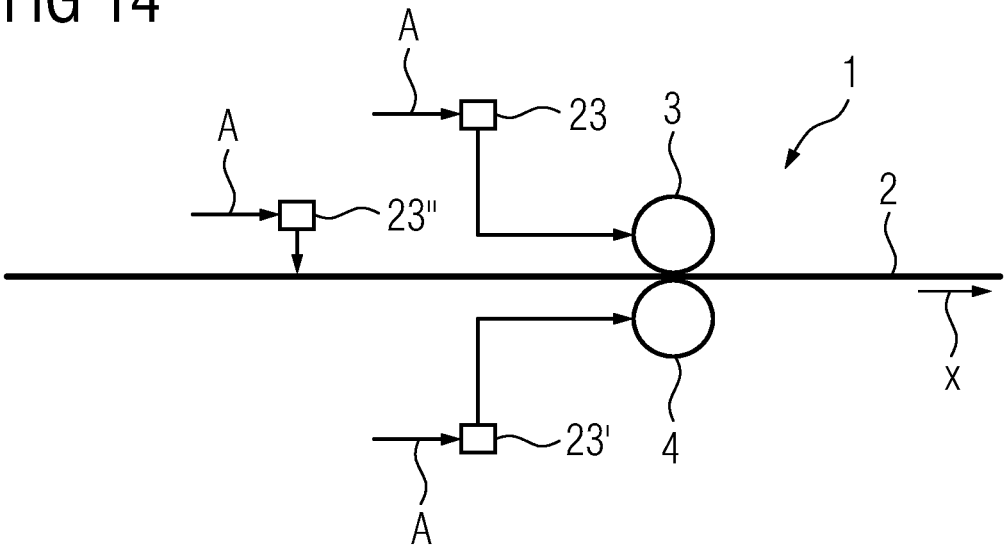
FIG. 14 shows a rolling stand and temperature modifications.

FIG. 14 shows a different type of control value A, which may optionally be determined in addition to the control value A which acts on the peripheral speeds vO, vU of the working rolls 3, 4. According to FIG. 14, the control value A can be a temperature modification of the upper working roll 3, which acts on the upper working roll 3 via a corresponding modification device 23. Cooling of the upper working roll 3 by spraying on water may be performed, for example. As an alternative or in addition, the control value A can be a temperature modification of the lower working roll 4. It is possible, for example, analogously to the upper working roll 3, for cooling of the lower working roll 4 by spraying on water to be performed by means of a corresponding modification device 23'. As an alternative or in addition, the control value A can be a temperature modification of the flat rolled product 2 before rolling in the first rolling stand 1. Heating of the flat rolled product 2, in particular inductive heating, may be performed by means of a corresponding modification device 23", for example.

The basic principle and various possible embodiments of the present invention have been explained above in conjunction with FIGS. 1 to 14. In the context of FIGS. 1 to 14, a reversing rolling mill that has just a single rolling stand 1, i.e. the first rolling stand 1, has been considered. However, entirely analogous embodiments are also possible if the rolling mill, whether or not embodied as a reversing rolling mill, additionally has further rolling stands, referred to below as second rolling stands 24.

Thus, in accordance with the illustration in FIGS. 15 to 20, for example, it is possible for the rolling mill to have a plurality of rolling stands 1, 24, through which the rolled product 2 runs sequentially in succession. In this case, therefore, the rolling mill is designed as a multi-stand rolling train. The respectively illustrated number of five rolling stands 1, 24 in total arranged in series is purely illustrative, however. In FIGS. 15 to 20 too, only the working rolls of the second rolling stands 24 are illustrated. In general, however, analogously to the first rolling stand 1, the second rolling stands 24 have further rolls. Furthermore, only the rolling stands 1, 24, the rolled product 2 and the sensor device 6 as well as optionally the further sensor device 13 are illustrated in FIGS. 15 to 20. The further components of the rolling mill, in particular the control device 9, are present, however.

Moreover, the control device 9 generally acts on all the rolling stands 1, 24 of the rolling mill, even if only the control of the first rolling stand 1 by means of the control value A is illustrated in FIGS. 15 to 20.

The embodiments in FIGS. 15 to 20 are largely similar. However, they differ in the arrangement of the sensor device 6, in the arrangement of the second rolling stands 24 relative to the sensor device 6 and to the first rolling stand 1, and in the presence or absence of the further sensor device 13.

Figure 15:
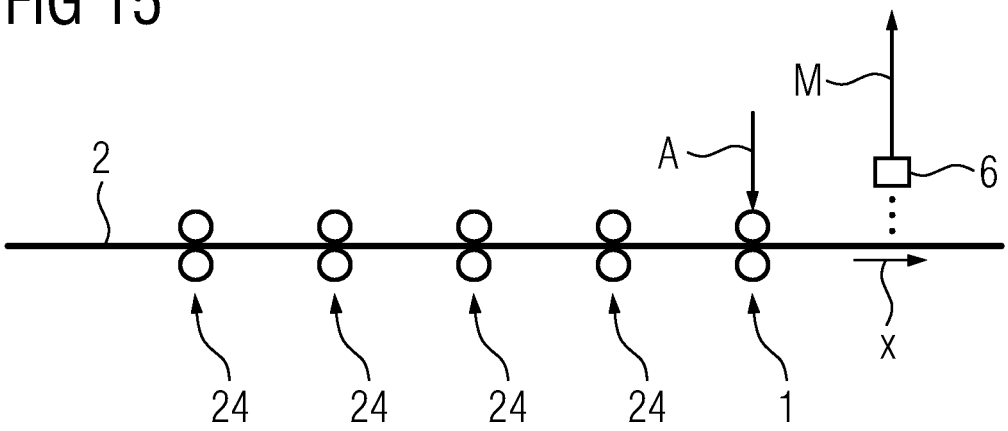
FIGS. 15 to 20 show various embodiments of rolling trains.
Figure 16:
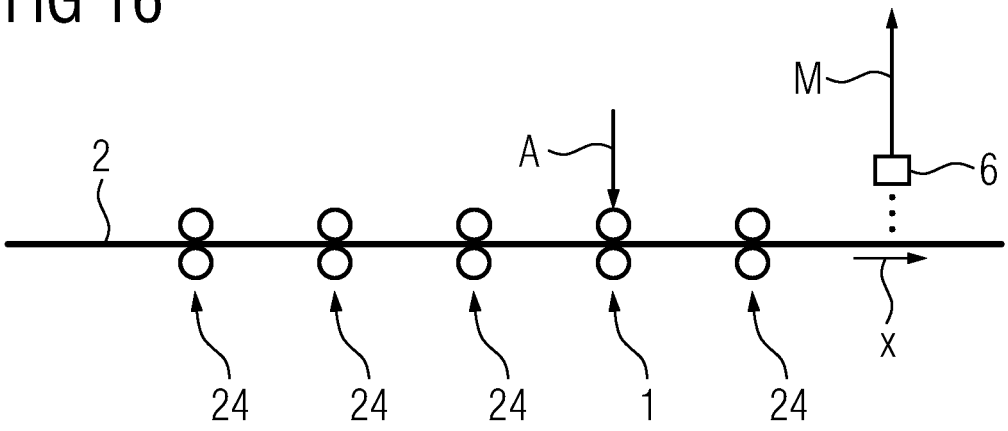
Figure 17:
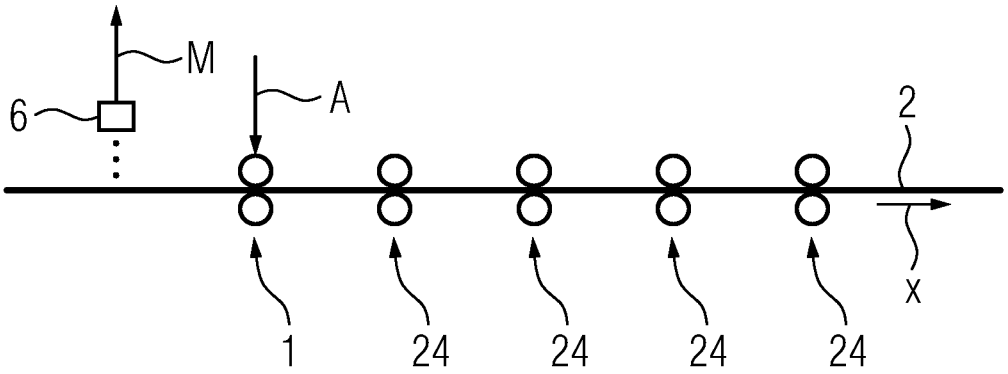
Figure 18:
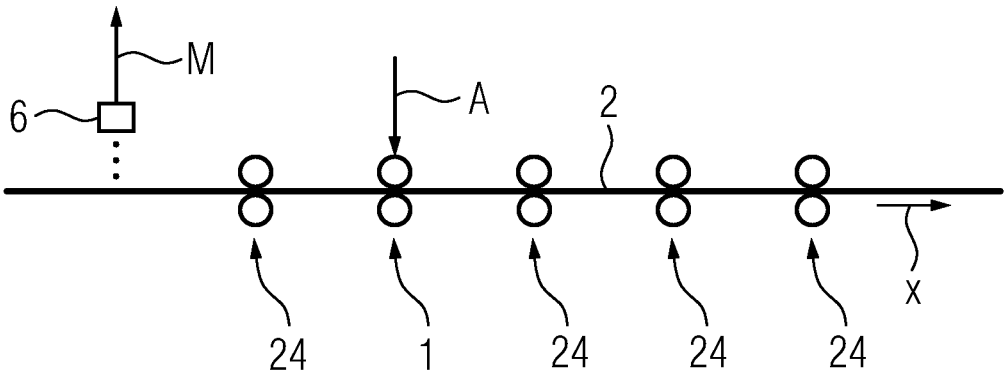

To be specific, the sensor device 6 in the embodiments in FIGS. 15 and 16 is arranged downstream of the last rolling stand 1, 24 of the rolling train. In the embodiment in FIG. 15, the control value A, i.e. the control value A determined taking into account the measured variable M, acts on the last rolling stand 1 of the rolling train. In this case, the second rolling stands 24 are not arranged between the sensor device 6 and the first rolling stand 1. In the embodiment in FIG. 16, in contrast, the control value A, i.e. the control value A determined taking into account the measured variable M, acts on a different rolling stand 1 of the rolling train, e.g. the penultimate rolling stand of the rolling train, that arranged immediately upstream of the last rolling stand 24 of the rolling train. In this case, at least one of the second rolling stands 24, specifically at least the last rolling stand 24 of the rolling train, is arranged between the sensor device 6 and the first rolling stand 1.

In the embodiments in FIGS. 17 to 20, the sensor device 6 is arranged upstream of the forwardmost upstream rolling stand 1, 24 of the rolling train. In the embodiments in FIGS. 17 and 19, the control value A, i.e. the control value A determined taking into account the measured variable M, acts on the forwardmost upstream rolling stand 1 of the rolling train. In this case, therefore, the second rolling stands 24 are not arranged between the sensor device 6 and the first rolling stand 1. In the embodiments in FIGS. 18 and 20, in contrast, the control value A, i.e. the control value A determined taking into account the measured variable M, acts on a different rolling stand 1 of the rolling train, e.g. on the rolling stand 1 arranged immediately downstream of the forwardmost rolling stand 24 of the rolling train. In this case, at least one of the second rolling stands 24, specifically at least the forwardmost upstream rolling stand 24 of the rolling train, is arranged between the sensor device 6 and the first rolling stand 1.

Figure 19:
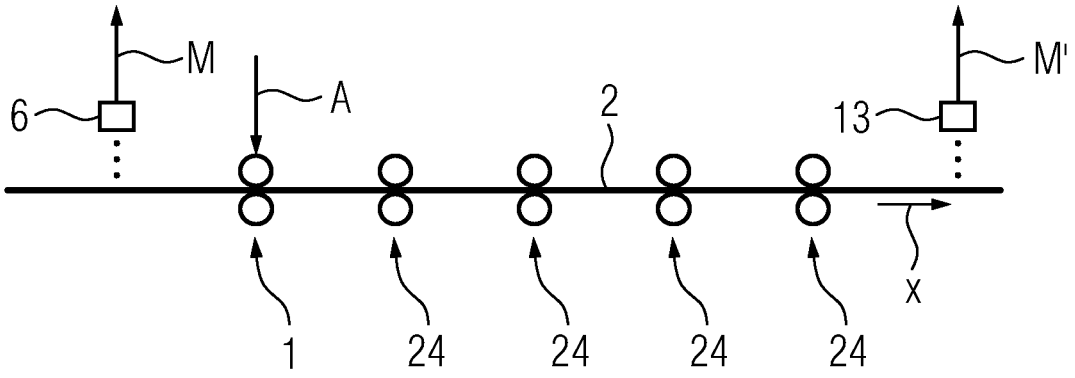
Figure 20:
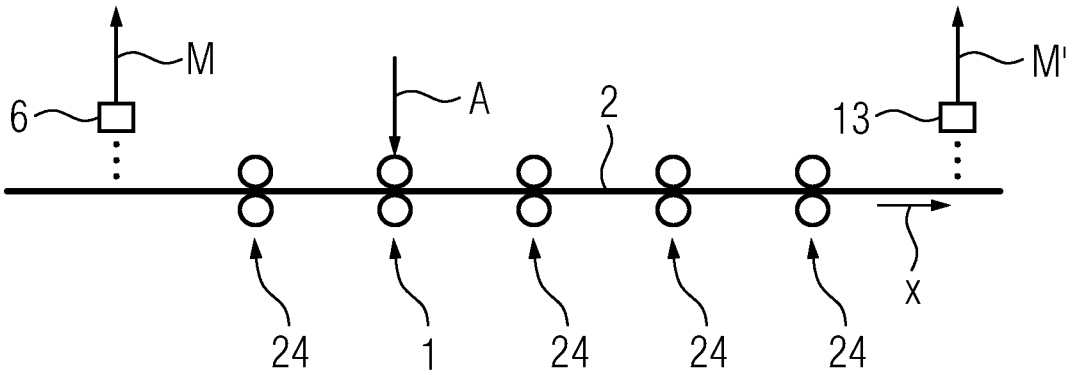

In the embodiments in FIGS. 19 and 20, the further sensor device 13 is furthermore arranged downstream of the last rolling stand 1, 24 of the rolling train, thus enabling the corresponding adaptation of the model 12 to be performed. In the embodiments in FIGS. 17 and 18, in contrast, the further sensor device 13 is not present.

The embodiments in FIGS. 15 to 20 are not the only possible embodiments of a multi-stand rolling train. It is possible, for example, for a plurality of second rolling stands 24 to be arranged between the first rolling stand 1 and the sensor device 6. In the extreme case, the sensor device 6 can be arranged downstream of the last rolling stand 24 of the rolling train and can act on the forwardmost upstream rolling stand 1 of the rolling train or, conversely, can be arranged upstream of the forwardmost rolling stand 24 of the rolling train and can act on the last rolling stand 1 of the rolling train. It is also possible to provide a plurality of sensor devices 6 and/or a plurality of further sensor devices 13, e.g. a respective sensor device 6 and/or a further sensor device 13 upstream and/or downstream of each individual rolling stand 1, 24 of the rolling train. It is also possible to implement such arrangements between some rolling stands 1, 24 but not in the case of all the rolling stands 1, 24. It is also possible for the control device 9 to use the measured variable M of a single sensor device to determine a plurality of control values A which each act on a different first rolling stand 1. The embodiment which is adopted in the specific case is at the discretion of the person skilled in the art.

Irrespective of which embodiment is adopted in any specific case, the mode of operation of the respective rolling mill in FIGS. 15 to 20 is the same, insofar as it applies to the present invention, as has been explained above in conjunction with FIGS. 1 to 14 for the reversing rolling mill with a single rolling stand 1, the first rolling stand 1.

The present invention has many advantages. In particular, simple integration of the procedure according to the invention into the continuous running of the rolling mill is possible. In the case of electrical steel sheets and also in the case of other steel grades, annealing after cold rolling or between two cold rolling steps is often no longer required or only still required to a limited extent. In the case of AHSS and of martensitic and bainitic grades, the banding of material properties, which is due to the cooling in the cooling section of the hot rolling train, can be reduced or eliminated. Insofar as the action on the flat rolled product 2 by means of the control value A can be performed with local resolution in the transverse direction of the flat rolled product 2, wherein this is the case especially with thermal modification, it may also be possible under certain circumstances for a plurality of sensor devices 6 to be arranged side-by-side.

Although the invention has been illustrated and described more specifically in detail by means of the preferred illustrative embodiment, the invention is not restricted by the examples disclosed, and other variants can be derived therefrom by a person skilled in the art without exceeding the scope of protection of the invention.

LIST OF REFERENCE SIGNS

1, 24 Rolling stands
2 Flat rolled product
3 Upper working roll
4 Lower working roll
5 Coiler
6, 13 Sensor devices
7 Excitation element
8*a* to 8*d* Sensor elements
9 Control device
10 Control program
11 Program code
12 Model
14 to 16 Drives
17 Transmission
18 Input shaft
19, 20 Output shafts
21 Splitter block
22 Intermediate transmission
23, 23', 23" Modification devices A Control value
a1, a2 Distances
d1, d2 Thicknesses
E Expected value
F Rolling force
IA, IW Currents
Ia to Id Sensor signals
k Model parameters
M, M' Measured variables
S1 to S18 Steps
t1, t2 Waiting times
T Temperature
v, v1, v2 Transport speeds
vO, vU Peripheral speeds
vO*, vU* Target values
x Transport direction

The invention claimed is:

1. A rolling mill for rolling a flat rolled product composed of metal comprising:

a first rolling stand for rolling the flat rolled product having an upper working roll and a lower working roll;

a sensor device configured for detecting at least one measured variable (M) characteristic of a material property of the metal forming the flat rolled product, the sensor device being arranged upstream and/or downstream of the first rolling stand, the detected material property being a metal property irrespective of a current state of the rolled product and irrespective of geometrical properties of the rolled product;

a control device for the rolling mill to which the sensor device is connected in order to receive the detected measured variable (M);

the control device is configured to determine a control value (A) for the control of the first rolling stand based at least in part on the measured variable (M) received from the sensor device, the determined control value (A) being determined to control the first rolling stand to change the material property of the metal forming the flat rolled product to a desired material property; wherein the determined control value (A) is a ratio of an upper peripheral speed (vO) at which the upper working roll rotates to a lower peripheral speed (vU) at which the lower working roll rotates.

2. The rolling mill as claimed in claim 1, further comprising the rolling mill having at least one second rolling stand, wherein the second rolling stands are not arranged between the sensor device and the first rolling stand, or wherein the rolling mill has at least one second rolling stand and wherein at least one of the second rolling stands is arranged between the sensor device and the first rolling stand.

3. The rolling mill as claimed in claim 1, further comprising the control device is configured and operable such that the control device determines the ratio of the upper peripheral speed (vO) to the lower peripheral speed (vU) and such that the ratio is between 0.5 and 2.0.

4. The rolling mill as claimed in claim 3, further comprising an upper drive operable for driving the upper working roll and a lower drive operable for driving the lower working roll, wherein driving of the lower working roll is different from driving the upper drive.

5. The rolling mill as claimed in claim 1, further comprising a common drive for driving the upper working roll and the lower working roll;

a transmission comprising an upper output shaft and a lower output shaft, the upper output shaft has a speed of an upper output shaft of the transmission, the upper output shaft which is connected for conjoint rotation to the upper working roll;

the transmission has a speed of a lower output shaft of the transmission, the lower output shaft being connected for conjoint rotation to the lower working roll, and the respective speeds of the upper and the lower output shafts can be continuously adjusted;

the transmission is arranged between a common drive on one side and the upper working roll and the lower working roll on another side.

6. The rolling mill as claimed in claim 1, further comprising the control device is configured and operable such that the control value (A) determined by taking into account the measured variable (M) is a temperature modification of the upper working roll and/or of the lower working roll of the first rolling stand and/or of the flat rolled product before rolling in the first rolling stand.

7. The rolling mill as claimed in claim 1, further comprising the sensor device is arranged upstream, in a path of the flat rolled product, of the first rolling stand;

the control device is configured and operable such that the control device outputs the control value (A) to the first rolling stand, and the control value (A) is determined taking into account the measured variable (M), which takes into account tracking of the flat rolled product from the sensor device to the first rolling stand.

8. The rolling mill as claimed in claim 7, further comprising the control device comprises a model by which the control device determines the control value (A) for the first rolling stand wherein the model takes into account the measured variable (M), and, takes into account the control value (A), determined taking into account the measured variable (M), and the model furthermore determines an expected value (E) for the material property of the flat rolled product after rolling in the first rolling stand;

a further sensor device, by which at least one further measured variable (M') characteristic of the material property of the flat rolled product can be detected after rolling in the first rolling stand, and the further sensor device is arranged downstream of the first rolling stand, and the further sensor device is connected to the control device to transfer the detected further measured variable (M');

the control device is configured and operable such that the control device uses the further measured variable (M') for a point in time which the control device determines taking into account tracking of the flat rolled product from the first rolling stand to the further sensor device; and the control device is configured and operable to adapt the model based on a comparison of the further measured variable (M') and the expected value (E) of the material property.

9. The rolling mill as claimed in claim 8, further comprising the control device is configured and operable such that, in determining the control value (A), the control device takes into account the temperature (T) of the flat rolled product before the rolling of the flat rolled product in the first rolling stand and/or the rolling force (F) during the rolling of the flat rolled product in the first rolling stand and/or the pass reduction during the rolling of the flat rolled product in the first rolling stand in addition to the transferred measured variable (M).

10. The rolling mill as claimed in, claim 1, further comprising the sensor device comprises an excitation element and a first sensor element, the excitation element is configured and operable for exciting a base signal in the flat rolled product;

a first sensor signal (Ia) based on the excited base signal is detected by the first sensor element; and the sensor device is configured and operable for determining the transferred measured variable (M), taking into account the first sensor signal (Ia), or wherein the transferred measured variable (M) comprises the first sensor signal (Ia).

11. The rolling mill as claimed in claim 10, further comprising the sensor device additionally comprises a plurality of second sensor elements; wherein when viewed in the transport direction (x) from the first sensor element, the respective second sensor element is arranged upstream or downstream of the first sensor element and/or is laterally offset so that a respective second sensor signal (Ib to Id) based on the excited base signal and of the same kind as the first sensor signal (Ia) is detected by means of the respective second sensor element; and the sensor device is configured and operable to determine the transferred measured variable (M) while also taking into account the respective second sensor signal (Ib to Id), or wherein the transferred measured variable (M) also comprises the respective second sensor signal (Ib to Id).

12. The rolling mill as claimed in claim 10, further comprising the base signal is an eddy current (IW) or a sound signal, or an ultrasound signal.

13. The rolling mill as claimed in claim 10, further comprising a connecting line from the excitation element to the first sensor element running parallel to the transport direction (x).

14. The rolling mill as claimed in claim 1, wherein the material property is an electromagnetic property or a mechanical property of the rolled product.

15. The rolling mill as claimed in claim 1, wherein the rolling mill is a cold rolling mill.

* * * * *